US007181036B1

(12) United States Patent
Whitaker

(10) Patent No.: US 7,181,036 B1
(45) Date of Patent: Feb. 20, 2007

(54) ANGLED MICROPHONE ASSEMBLY

(76) Inventor: Steve Whitaker, 10429 Highway 181 #28, San Antonio, TX (US) 78223

( * ) Notice: Subject to any disclaimer, the term of this patent is extended or adjusted under 35 U.S.C. 154(b) by 0 days.

(21) Appl. No.: 11/056,710

(22) Filed: Feb. 11, 2005

Related U.S. Application Data

(60) Provisional application No. 60/558,842, filed on Apr. 2, 2004.

(51) Int. Cl.
*H04R 25/00* (2006.01)

(52) U.S. Cl. ..... 381/361; 381/362; 381/363

(58) Field of Classification Search ..... 381/361, 381/362, 363, 364, 365, 366, 355, 356, 369, 381/91, 122, 375; 248/603, 604, 610, 612, 248/622, 618, 638, 628
See application file for complete search history.

(56) References Cited

U.S. PATENT DOCUMENTS 3,153,123 A * 10/1964 Harman ..... 381/363
3,324,254 A 6/1967 Shaw et al.
3,573,401 A 4/1971 Lininger
D251,908 S 5/1979 Fujita
D268,672 S 4/1983 McPherson
D278,233 S 4/1985 Hardy
4,991,220 A 2/1991 Wolf
6,682,043 B1 * 1/2004 Hsieh ..... 248/638

* cited by examiner

*Primary Examiner*—Huyen Le
(74) *Attorney, Agent, or Firm*—Kenneth L Tolar

(57) ABSTRACT

An angled microphone assembly for more conveniently mounting a microphone within confined spaces includes a head section, an intermediate adaptor section and a handle section. The adaptor section includes a vertical lower leg having an upper leg angularly extending therefrom. The angle between the central axis of the upper leg is approximately sixty degrees relative to the central axis of the lower leg. Accordingly, when the microphone assembly is mounted on a conventional stand, the head section extends obliquely while the handle section and accompanying cable vertically depend from the adaptor section thereby minimizing interference with surrounding objects.

3 Claims, 1 Drawing Sheet

ANGLED MICROPHONE ASSEMBLY

CROSS REFERENCE TO RELATED APPLICATIONS

This application is entitled to the benefit of provisional application No. 60/558,842 filed on Apr. 2, 2004.

BACKGROUND OF THE INVENTION

The present invention relates to a microphone assembly having an angled intermediate portion allowing it to more easily fit within confined spaces.

DESCRIPTION OF THE PRIOR ART

Microphone assemblies typically include an elongated handle portion coupled with a head portion having a mouthpiece mounted thereon. A coaxial cable extends from the lower end of the handle portion that connects the mouthpiece to an amplifier. The microphone is usually mounted on a stand so as to be positioned immediately adjacent a musician or an instrument. In order to achieve maximum sound reproduction and amplification, the microphone is typically mounted horizontally or obliquely. As such, the cable extends outwardly from the stand whereby mounting the microphone assembly within a confined space can be difficult and obtrusive. For example, a conventional microphone positioned adjacent a drummer may hinder his or her stick motion. Moreover, if the microphone is mounted on a small stage in front of an instrument amplifier or other musical device, the outwardly protruding cable may interfere with the musician's movement about the stage.

A review of the prior art indicates no devices that address the above described problem. For example, U.S. Pat. No. 3,324,254 issued to Shaw discloses a microphone holder including means for inhibiting vibration.

U.S. Pat. No. 3,573,401 issued to Lininger discloses a microphone stand including a circular elastomeric body having an annular groove for receiving an annular portion of a microphone clamp assembly.

U.S. Pat. No. D251,908 issued to Fujita discloses an ornamental design for a microphone holder.

U.S. Pat. No. 4,991,220 issued to Wolf discloses a shock-absorbing microphone support member including a loop having a microphone clamping member positioned thereon.

U.S. Pat. No. D268,672 issued to McPherson discloses an ornamental design for a microphone adapter mount including a bushing portion and a nipple portion.

U.S. Pat. No. D278,233 issued to Hardy discloses an ornamental design for a microphone mounting stand.

As indicated above, numerous microphone mounting devices exist in the prior art. However, none of the above referenced patents identically disclose, either individually or in combination, a device that minimizes the obtrusiveness of a microphone assembly. The present invention addresses this problem by providing a uniquely configured microphone assembly having an angled intermediate portion that effectively reduces the depth of the assembly. Additionally, the design directs the microphone cable downwardly thereby minimizing interference with a musician, instruments or other objects.

SUMMARY OF THE INVENTION

The present invention relates to an angled microphone assembly. The device comprises a head section having an upper end and a lower end with a mouthpiece at the upper end and an internally threaded portion at the lower end. An angled intermediate adaptor section is threadedly coupled to the lower end of head section. A handle section is threadedly coupled to an opposing end of the adaptor section. In the preferred embodiment, the upper end of the adaptor section extends at a sixty degree angle relative to a vertical plane although the angle can be varied.

To use the above described device, the microphone wiring is extended through both the handle section and the adaptor and is then fastened to corresponding terminals on the head section. The adaptor section is then fastened between the handle and head sections and the microphone is mounted onto a conventional microphone stand. Accordingly, the head section will extend outwardly and upwardly at a predetermined angle so as to properly capture sound emanating from a musical device. Additionally, the handle section and the microphone cable will extend downwardly so as not to interfere with adjacent objects or musicians.

It is therefore an object of the present invention to provide a microphone assembly that can be more easily mounted within confined spaces.

It is another object of the present invention to provide a microphone assembly that minimally interferes with a musician's movement within the vicinity thereof.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
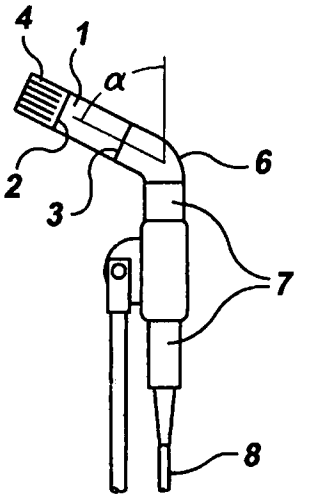
FIG. 2 is a side, plan view of the microphone assembly according to the present invention.
Figure 4:
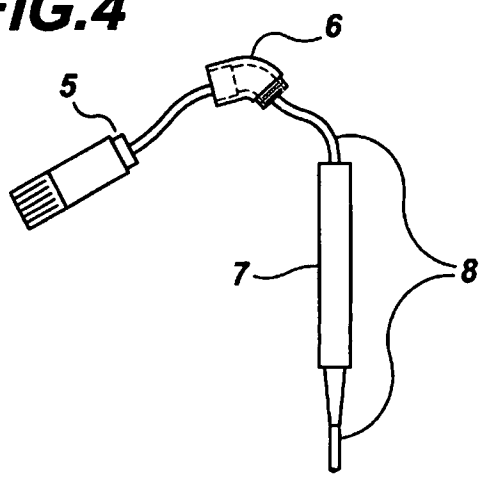
FIG. 4 is an exploded view of the microphone assembly.
Figure 1:
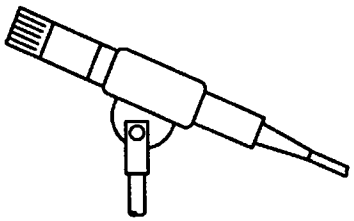
FIG.1 PRIOR ART
FIG. 1 is a side, plan view of a conventional microphone assembly.
Figure 3:
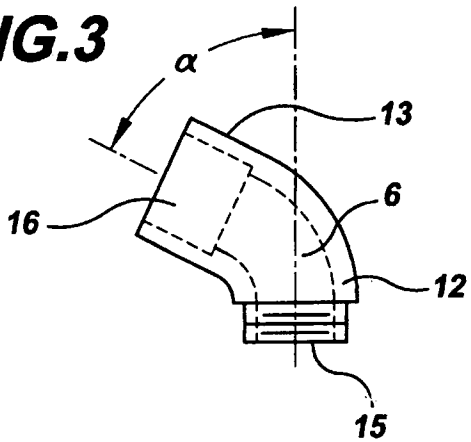
FIG. 3 is a side view of the adaptor section.

The present invention relates to an angled microphone assembly. The device comprises a head section 1 having an upper end 2 and a lower end 3 with a mouthpiece 4 at the upper end and an internally threaded portion 5 at the lower end. An angled intermediate adaptor section 6 includes a vertical lower leg 12 with an upper leg 13 obliquely extending therefrom. In the preferred embodiment, the upper leg of the adaptor section extends at a sixty degree angle relative to the central axis of the lower leg although the angle can be varied. The upper leg includes an internally threaded portion 16 that is coupled with the lower end of head section. The lower leg includes an externally threaded rim 15 that is fastened to an internally threaded end of a handle section 7. The handle section includes a microphone cable 8 that electrically connects the mouthpiece to an amplifier.

To use the above described device, a microphone cable 8 is extended through both the handle section and the adaptor and is then electrically connected to corresponding terminals on the head section. The adaptor section is fastened between the handle and head sections and the microphone is mounted onto a conventional microphone stand. Accordingly, the head section will extend outwardly and upwardly at a predetermined angle so as to properly capture sound emanating from a musical device. Additionally, the handle section and the microphone cable will extend downwardly so as not to interfere with adjacent objects or musicians.

The above described device is not limited to the exact details of construction and enumeration of parts provided herein. For example, the microphone assembly can include the head, handle and adaptor sections or only the adaptor section for converting a conventional microphone assembly to an angled microphone assembly. Furthermore, the size, shape and materials of construction can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An angled microphone comprising:

a head section having an upper end and a lower end with a mouthpiece at the upper end;

an angled intermediate adaptor section threadedly coupled with the lower end of head section;

a handle section threadedly coupled with an opposing end of the adaptor section;

a cable depending from the handle section and electrically connected to said mouthpiece for interconnecting said mouthpiece with an amplifier.

2. The angled microphone assembly according to claim 1 wherein said adaptor section includes a vertical lower leg and an upper leg obliquely extending from said lower leg whereby said head section extends upwardly at an angle relative to a vertical plane and said handle section extends vertically.

3. The angled microphone assembly according to claim 2 wherein the upper leg of the adaptor section extends at a sixty degree angle relative to a central axis of said lower leg.

* * * * *